United States Patent [19]

Correll

[11] Patent Number: 4,812,707

[45] Date of Patent: Mar. 14, 1989

[54] TRAVELING WAVE PUSH-PULL ELECTRON BEAM DEFLECTION STRUCTURE HAVING VOLTAGE GRADIENT COMPENSATION

[75] Inventor: Ronald E. Correll, Tualatin, Oreg.

[73] Assignee: Tektronix, Inc., Beaverton, Oreg.

[21] Appl. No.: 114,466

[22] Filed: Oct. 30, 1987

[51] Int. Cl.[4] ..... H01J 29/70

[52] U.S. Cl. ..... 313/435; 313/436; 313/439; 313/450; 315/5.24

[58] Field of Search ..... 313/432, 436, 435, 439, 313/450; 315/5.26, 5.24, 7

[56] References Cited

U.S. PATENT DOCUMENTS

| | | | |
|---|---|---|---|
| 2,904,712 | 9/1959 | Schlesinger | 313/435 |
| 2,922,074 | 1/1960 | Moulton | 313/439 |
| 3,174,070 | 3/1965 | Moulton | 313/432 X |
| 3,796,910 | 3/1974 | Ritz, Jr. | 313/450 X |
| 4,207,492 | 6/1980 | Tomison et al. | 313/421 X |

*Primary Examiner*—Palmer C. DeMeo

*Attorney, Agent, or Firm*—John D. Winkelman; Paul S. Angello

[57] ABSTRACT

An electron beam deflection structure (10) of the traveling wave type effectively cancels the longitudinal voltage gradients and the associated electron beam defocusing that are characteristic of such deflection structures. The deflection structure comprises a first helical coil member (48) and a second helical coil member (50) that are coaxial with the longitudinal axis (26) of the tube. Each of the coil members has wide and narrow segments which alternate along the length of the coil in sequence with the turns of the coil. The first coil member has its wide segments (**92*a*) positioned on the bottom and its narrow segment (92*b*) on top of the coil member. The second coil member has its wide segments (94*a*) positioned on top and its narrow segments (94*b*) positioned on the bottom of the coil member. The narrow segments from one of the coil members are interleaved with the wide segments from the other coil member. A pair of linear arrays (100) and (102**) are thereby formed which are positioned above and below the electron beam path and comprise wide and narrow segments from different coil members. Differential voltage signals of opposite polarity are applied to the first and second coil members of the deflection structure. Longitudinal voltage gradients along the wide segments are compensated by substantially equal but opposite voltage gradients on the narrow segments, thereby effectively canceling the longitudinal voltage gradients and eliminating any defocusing of the electron beam that the voltage gradients would cause.

15 Claims, 3 Drawing Sheets

TRAVELING WAVE PUSH-PULL ELECTRON BEAM DEFLECTION STRUCTURE HAVING VOLTAGE GRADIENT COMPENSATION

TECHNICAL FIELD

This invention relates to traveling wave type structures for deflecting electron beams, and in particular, to deflection structures having the capability of operating at very high frequencies.

BACKGROUND OF THE INVENTION

A delay line deflection structure is a deflection structure of the traveling wave type used in electron discharge tubes, such as cathode-ray tubes for high frequency oscilloscopes, to reduce the magnitude of deflection signal velocity in the propagation direction of electrons in the electron beam. Traveling wave delay line deflection structures generally comprise a pair of deflection members disposed on opposite sides and extending along the path of an electron beam. An electric field varying in intensity and direction in accordance with the magnitude and polarity of the deflection signal deflects the electron beam. A delay is introduced to reduce the speed of deflection signal propagation along the deflection structure until such speed equals that of the beam electrons, thereby allowing accurate beam deflection by high frequency signals.

Delay line deflection structures generally include meander line and helical deflection structures. By reason of its design, a helical deflection structure has an inherent capability of providing characteristic impedances exceeding those obtainable in meander line deflection structures. However, in conventional delay line structures, longitudinal voltage gradients of increasing intensities develop along the length of the deflection structure in proportion to an increase in the frequency of the deflection signal for frequencies of greater than 1 GHz. Since the potentials applied to the pair of deflection members are of opposite polarity, the voltage gradients in the direction of electron beam travel are positive for one of the deflection members and negative for the other deflection member. Consequently, electrons on the side of the electron beam adjacent to one of the deflection members are accelerated while electrons on the side of the beam adjacent to the other deflection member are de-accelerated. The result of these acceleration and de-acceleration effects is a significant defocusing of the electron beam and a deterioration of display resolution.

It is, therefore, an object of the present invention to provide in an electron discharge tube such as a cathode-ray tube a deflection structure that substantially eliminates the phenomenon of defocusing that results from longitudinal voltage gradients at very high frequencies.

It is another object of the present invention to provide such a deflection structure that produces accurate deflection effects, is reliable in service, and is economically feasible to manufacture.

SUMMARY OF THE INVENTION

The present invention constitutes an electron beam deflection structure of the traveling wave type for use in the cathode-ray tube of a very high frequency oscilloscope. The deflection structure comprises first and second helical coil members wound around a common longitudinal axis. Each of the coil members has wide and narrow segments which alternate along the length of the coil in sequence with the turns of the coil. The first coil member has its wide segments positioned on the bottom and its narrow segments on top of the coil member. The second coil member has its wide segments positioned on top and its narrow segments on the bottom of the coil member. The narrow segments from one of the coil members are interleaved with the wide segments from the other coil member. A pair of linear arrays are thereby formed which are positioned above and below the electron beam path and comprise wide and narrow segments from different coil members.

In operation, differential signals of opposite polarity are applied to the first and second coil members of the deflection structure. The signals propogate along the coil members at a speed equal to the speed at which the beam electrons propagate toward the display screen. Since deflection effects depend on plate area, the wide segments of the first and second coil members on the bottom and top, respectively, of the coil members cooperate to provide net vertical deflection effects. The narrow segments of the first and second coil members on the top and bottom, respectively, of the coil members cooperate to effectively cancel longitudinal voltage gradients, which contribute to electron beam defocusing.

In particular, longitudinal voltage gradients developing along the first and second coil members are of substantially equal magnitude but are of opposite polarity. For example, the voltage gradients developing on the first and second coil members are of positive and negative polarity, respectively, in the direction of electron beam travel. The effective cancellation of the voltage gradients takes place because the voltage gradient of positive polarity on the wide segments on the bottom of the first coil member is effectively canceled by the substantially equal voltage gradient of negative polarity on the narrow segments on the bottom of the second coil member. Similarly, the voltage gradient of negative polarity on the wide segments on top of the second coil member is effectively cancelled by the substantially equal voltage gradient of positive polarity on the narrow segments on top of the first coil member.

DESCRIPTION OF PREFERRED EMBODIMENT

Figure 1:
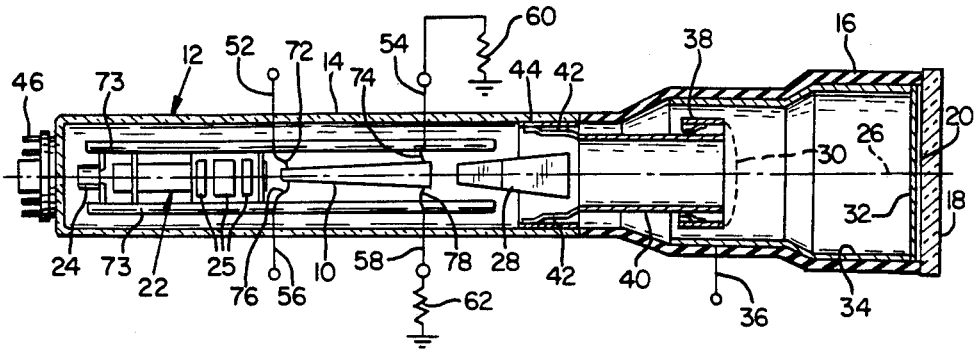
FIG. 1 is a longitudinal sectional side view of a very high frequency cathode-ray tube incorporating the electron beam deflection structure of the present invention.

With reference to FIG. 1, an electron beam deflection structure 10 of the traveling wave delay line type in accordance with the present invention is contained within the evacuated envelope of an otherwise conventional cathode-ray tube 12. The envelope includes tubular glass neck 14, ceramic funnel 16, and transparent glass face plate 18 sealed together by devitrified glass seals. A layer 20 of a phosphor material is coated on the inner surface of face plate 18 to form a fluorescent display screen for the cathode-ray tube. Electron gun 22 including cathode 24 and focusing anodes 25 is supported inside neck 14 at the opposite end of the tube to produce a focused beam of electrons directed along a central longitudinal axis 26 and toward the fluorescent screen.

The electron beam is deflected in the vertical direction by the delay line deflection structure 10 and in the horizontal direction by a pair of conventional electrostatic deflection plates 28 (only one shown) when deflection signals are applied thereto. Subsequent to deflection, the electron beam is accelerated by a high potential electrostatic field and strikes the display screen at a high velocity. This post-deflection acceleration field is produced between mesh electrode 30 and a thin, electron transparent aluminum film 32 overlaying phosphor layer 20. Film 32 is electrically connected to conductive layer 34 deposited on the inner surface of funnel 16. Conductive layer 34 terminates just to the left of electrode 30 as shown and is connected through feed-through connector 36 to an external high voltage DC source of approximately +3 kilovolts when cathode 24 is grounded.

Mesh electrode 30 is supported on metal ring 38 attached to the forward end of support cylinder 40. A plurality of spring contacts 42 attached to the rear end of the cylinder engage a conductive coating 44 on the inner surface of neck 14. Mesh electrode 30 and support cylinder 40 are electrically connected through base pins 46 to the average potential difference between horizontal deflection plates 28, which is approximately ground potential. This provides a field-free region between electrode 30 and the output ends of horizontal deflection plates 28. The electrodes of electron gun 22 are connected to the exterior of the envelope and to external circuitry through base pins 46.

The deflection structure 10 includes a first helical coil member 48 (FIG. 4) and a second helical coil member 50 (FIG. 4) which are connected to separate input and output neck pins. Neck pins 52 and 54 are attached to the respective input and output ends of first coil member 48, and neck pins 56 and 58 are attached to the respective input and output ends of second coil member 50.

Each of input neck pins 52 and 56 is connected to one output of a double-ended, push-pull vertical amplifier (not shown), which provides the vertical deflection signal voltages of a cathode-ray tube oscilloscope. Resistor 60 is connected to output pin 54 to terminate first coil member 48 in its characteristic impedance, and resistor 62 is connected to output pin 58 to terminate second coil member 50 in its characteristic impedance. Horizontal deflection plates 28 are also connected to neck pins (not shown) which extend through the envelope neck portion and are connected to the time base ramp voltage outputs of the horizontal amplifier of the oscilloscope.

Figure 2:
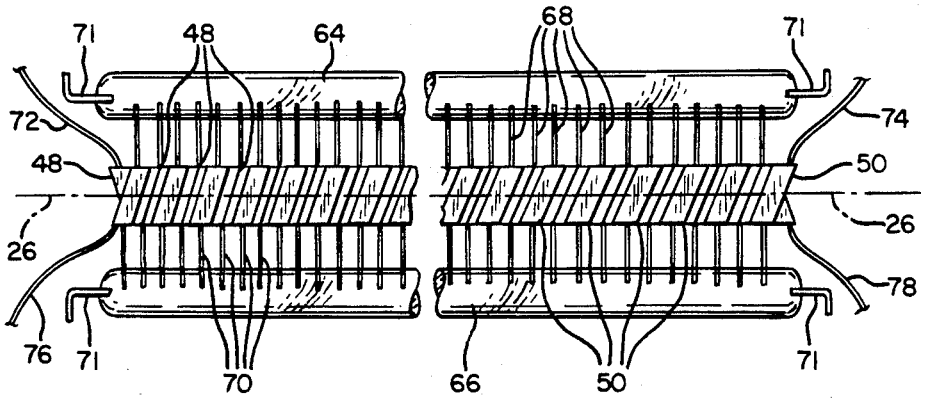
FIG. 2 is a top view of the deflection structure of the present invention.

With reference to FIG. 2, a top view of the deflection structure 10 is shown. The deflection structure 10 is supported between two glass rods 64 and 66 by two sets of support pins 68 and 70 which extend out from the sides of the structure 10 into the rods 64 and 66, respectively. Metal brackets 71 are embedded in the ends of glass rods 64 and 66. Metal brackets 71 are welded to standard metal wafers (not shown) positioned at opposite ends of deflection structure 10 and are held by four main glass rods 73 (FIG. 1, only two shown), thereby supporting deflection structure 10 within cathode-ray tube 12.

Conductors 72, 74, 76, and 78 connect the end portions of coil members 48 and 50 to the neck pins 52, 54, 56, and 58, respectively. Each of the coil members 48 and 50 comprises a coil having plural rectangular turns that are wound around a longitudinal axis. When they are installed in cathode-ray tube 12, coil members 48 and 50 are coaxial with axis 26 and form a rectangular passageway 80 (FIG. 7) down which an electron beam may propagate while at the same time being subjected to the influence of electrical potentials applied to the coil members 48 and 50.

Figure 3A:
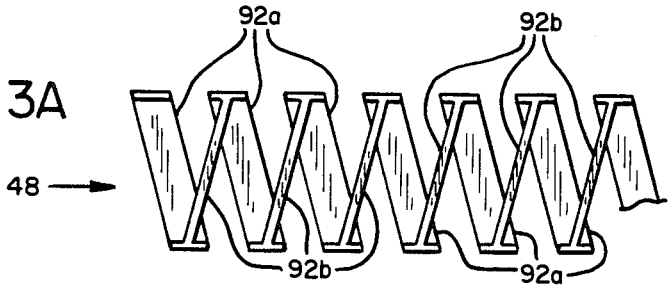
FIGS. 3A and 3B are separate enlarged top views of representative portions of the two coil member components of the deflection structure of the present invention.
Figure 3B:
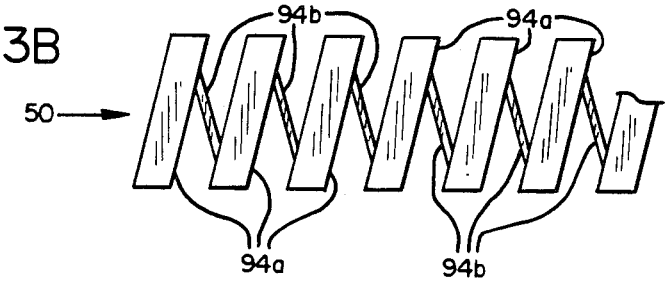

With reference to FIGS. 3A and 3B, the individual coil members 48 and 50 which comprise the structure 10 are separately shown in greater detail. The members 48 and 50 are helical coils having sets of axially wide segments and axially narrow segments which alternate in sequence with the turns of the coils. The relative axial widths of the segments are defined in a direction that is approximately parallel to the central longitudinal axis 26. The wide segments have approximately eight times the width of the narrow segments. The coil member 48 has a set of wide segments 92*a* which alternate along the length of the member with narrow segments 92*b*. The wide segments 92*a* form a bottomside of the coil member 48, and the narrow segments 92*b* form its topside. The coil member 50 has a set of wide segments 94*a* which alternate along the length of the member with narrow segments 94*b*. The wide segments 94*a* form a topside of the coil member 50, and the narrow segments 94*b* form its bottomside.

Figure 4:
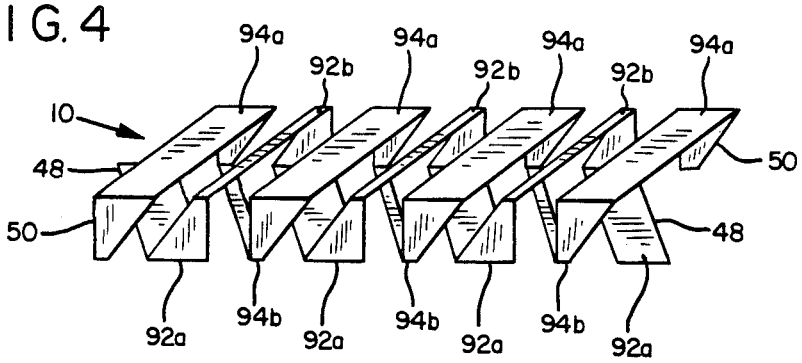
FIG. 4 is an axially expanded elevated isometric side view of a portion of the deflection structure of the present invention.

With reference to FIG. 4, the coil members 48 and 50 are intertwined in a bifilar fashion so that the axially narrow segments 92*b* of the member 48 are adjacent to and interleaved with the axially wide segments 94*a* of the member 50 and so that the axially narrow segments 94*b* of member 50 are adjacent to and interleaved with the axially wide segments 92*a* of member 48. The members 48 and 50 are carefully spaced apart so that there is no electrical contact between them.

Figure 5:
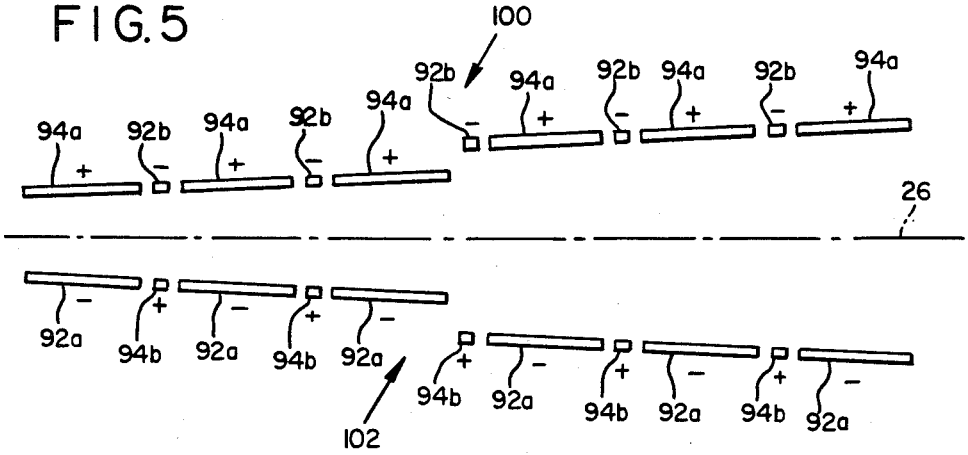
FIG. 5 is an enlarged longitudinal sectional side view of a representative portion of the deflection structure of the present invention, with portions of the deflection structure omitted.

With reference to FIG. 5, the interleaved segments along the topsides and bottomsides of the coil members 48 and 50 form a pair of linear arrays 100 and 102. The first array 100 corresponds to the topside of the deflection structure 10 and comprises the axially wide plate segments 94*a* of the coil member 50 which are interleaved with the axially narrow plate segments 92*b* of coil member 48. The second array 102 corresponds to the bottomside of the deflection structure 10 and comprises the axially wide plate segments 92*a* of coil member 48 which are interleaved with the axially narrow plate segments 94*b* of coil member 50. Linear arrays 100 and 102 progressively diverge apart along the length of deflection structure 10 in the direction of electron beam travel.

In operation, the coil members 48 and 50 operate as delay line structures. Electrical signals applied to the coil members 48 and 50 vertically deflect the electron beam propagating along central longitudinal axis 26 between the arrays 100 and 102 of the deflection structure 10. Since deflection effects depend on plate area, the axially wide plate segments 92*a* of coil member 48 on the bottomside of deflection structure 10 cooperate with the axially wide plate segments 94*a* of coil member 50 on the topside of the deflection structure 10 to provide net vertical deflection effects. The axially narrow plate segments 92*b* of coil member 48 on the topside of deflection structure 10 cooperate with the axially narrow plate segments 94*b* of coil member 50 on the bottomside of deflection structure 10 to effectively cancel longitudinal voltage gradients, thereby eliminating the associated defocusing of the electron beam.

In particular, longitudinal voltage gradients that develop along coil members 48 and 50 are of substantially equal magnitude but are of opposite polarity. With particular reference to FIG. 5, coil members 48 and 50 are shown to be carrying deflection signals of negative and positive polarity, respectively. The voltage gradients developing on the coil members 48 and 50 are, therefore, of positive and negative polarity, respectively, in the direction of electron beam travel. The effective cancellation of the voltage gradients takes place because the voltage gradient of positive polarity on the axially wide plate segments 92*a* on the bottom of the coil member 48 is effectively canceled by the substantially equal voltage gradient of negative polarity on the axially narrow plate segments 94*b* on the bottom of the coil member 50. Similarly, the voltage gradient of negative polarity on the axially wide segments 94*a* on top of the coil member 50 is effectively canceled by the substantially equal voltage gradient of positive polarity on the axially narrow segments 92*b* on top of the coil member 48. Since the voltage gradients along the length of deflection structure 10 are effectively canceled, deflection structure 10 provides substantially no longitudinal acceleration of beam electrons and, therefore, does not defocus the beam.

In a conventional delay line deflection structure, the intensity of the deflecting field is inversely proportional to the frequency of the deflection signal. This characteristic is believed to be caused by the concentration of the energy in the electric field generated by the deflection signal in areas between adjacent elements in the deflection structure. In particular, potential differences between adjacent elements concentrate electric field energy in the areas between the elements, thereby weakening the deflecting field. Deflection structure 10 overcomes this problem by providing fixed potential differences along the length of the deflection structure. The fixed potential differences provide deflection sensitivity that is independent of the frequency of the deflection signal.

Figure 6:
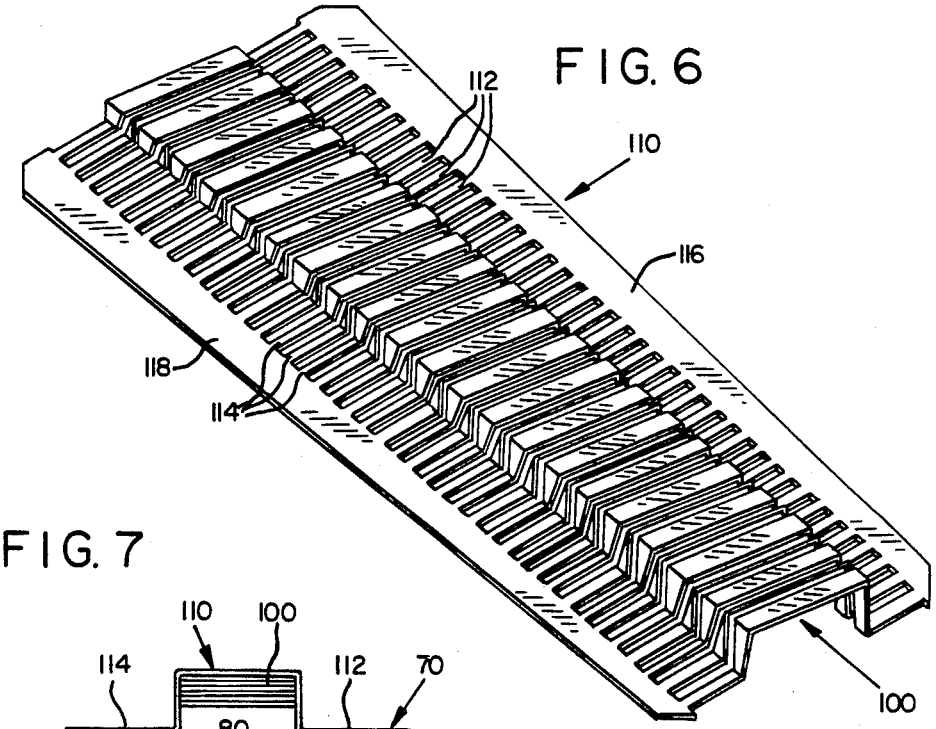
FIG. 6 is an isometric view of a half-section used in manufacturing the deflection structure of the present invention.
Figure 7:
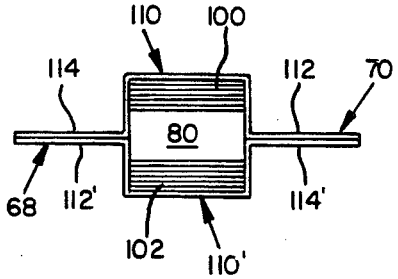
FIG. 7 is a diagrammatic lateral sectional view illustrating the construction of the deflection structure of the present invention.

With reference to FIGS. 5, 6, and 7, the deflection structure 10 may be manufactured by preparing two similar half sections 110 and 110' corresponding to the respective top and bottom portions of the structure 10. The half sections 110 and 110' are made of stainless steel and constitute the arrays 100 and 102, respectively. The half sections 110 and 110' have similar components identified by identical reference numerals, and the reference numerals followed by primes represent the components of half section 110'. The following description is directed only to half section 110.

Two sets of lead segments 112*a* and 114*a* extend from opposite sides of the plate segments 94*a* and 92*b* of the array 100. The lead segments 112*a* and 114*a* are connected to support plates 116*a* and 118*a*, respectively, which hold the plate segment 94*a* and 92*b* in array 100 in proper orientation during the assembly of deflection struction 10.

To assemble deflection structure 10, the half sections 110*a* and 110' are positioned in "face-to-face" relation but are offset so that the lead segments connected to axially wide segments in one of the half sections 110*a* and 110' are aligned with the lead segments connected to the axially narrow plate segments in the other of the half sections. The lead segments 112*a* are welded to different ones of the lead segments 114*b*, and the lead segments 114*a* are welded to different ones of the lead segments 112*b*, thereby to form the coil members 48 and 50. The support plates 116*a*, 116*b*, 118*a*, and 118*b* are trimmed away leaving the deflection structure 10 with the welded lead segments forming the mounting pins 68 and 70 required for mounting.

As may be apparent from the preceding description, certain changes may be made in the above constructions without departing from the scope of the invention. For example, deflection structure 10 has been described in connection with a high-frequency direct view cathode-ray tube 12 having a display screen on which output images are formed. It will be appreciated, however, that deflection structure 10 can also be used in a cathode-ray tube that generates electronic output signals. Therefore, the embodiment described in the drawings is intended to be illustrative in nature and is not meant to be interpreted as limiting the following claims.

I claim:

1. An electron beam deflection structure for use in an electron discharge tube having a central longitudinal axis extending along the direction of electron beam propagation, comprising:

a pair of bifilar helical coils coaxial with said central longitudinal axis, each of said coils including alternating plate segments of substantially greater area and substantially lesser area, the plate segments of the coils being interlaced together along the lengths thereof to form a pair of linear arrays which extend along said central longitudinal axis and are positioned on opposite sides of said axis, each of said arrays including plates of greater area from one of said coils and the plates of lesser area from the other of said coils.

2. The deflection structure of claim 1, wherein:

the plate segments comprising said arrays progressively diverge apart along the length of said structure in the direction of propagation of said electron beam.

3. The deflection structure of claim 1, wherein:

each of said coils includes a plurality of rectangular turns, a pair of opposite sides of which are constructed and arranged to form said arrays of plate segments.

4. The deflection structure of claim 1, wherein said coils comprise:

a first half section including one array of said plate segments and two sets of lead segments extending from opposite sides of said plate segments, a second half section similar to said first half section including the other array of said plate segments and two sets of lead segments extending from opposite sides of said plate segments of said other array, and means for connecting the lead segments from said plate segments of substantially greater area in each of said half sections to the lead segments of the plate segments of substantially lesser area in the other of said half sections.

5. The device of claim 1, wherein said plate segments are of substantially rectangular shape and of substantially the same length.

6. An apparatus for use in deflecting an electron beam propagating along a path in an electron discharge tube having a central longitudinal axis extending along the path of electron beam propagation, comprising:

a deflection structure including first and second helical coils interlaced in bifilar fashion and coaxially positioned with respect to said central longitudinal axis, said first coil having alternating beam deflection segments of substantially greater area and of substantially lesser area positioned along respective first and second opposite sides of said path of electron beam propagation, and said second coil having alternating beam deflection segments of substantially lesser area and of substantially greater area positioned along said first and second sides, respectively.

7. The apparatus of claim 6, wherein:

said segments of said coils progressively diverge apart in the direction of propagation of said electron beam.

8. The apparatus of claim 6, wherein said beam deflection segments are of substantially rectangular shape and of substantially the same length.

9. In a cathode-ray tube, a device for deflecting in accordance with first and second differential input deflection signals an electron beam propagating along a path in the tube, comprising:

first and second delay line structures extending along opposite sides of said propagation path of said electron beam, said first delay line structure including:

a first set of axially wide beam deflection segments that conduct said first deflection signal, and a second set of axially narrow beam deflection segments interleaved with said first set of beam deflection segments and conducting said second deflection signal; and said second delay line structure including:

a third set of axially narrow beam deflection segments electrically connected to said first set of beam deflection segments to conduct said first deflection signal, and a fourth set of axially wide beam deflection segments interleaved with said third set of beam deflection segments and electrically connected to said second set of beam deflection segments to conduct said second deflection signal.

10. The device of claim 9, wherein:

said first and said second delay line structures diverge transversely apart in the direction of propagation of said beam.

11. The device of claim 9, wherein:

said first and second delay line structures comprise a pair of bifilar helical coils.

12. A cathode-ray tube, comprising:

beam emitting means positioned near one end of said tube for directing an electron beam along a central longitudinal axis in said tube toward a display screen positioned near an opposite end of said tube; and an electron beam deflection structure including a pair of helical coils coaxially positioned with respect to said axis and interlaced in a bifilar fashion, each of said coils including alternating beam deflection segments of substantially greater area and of substantially lesser area positioned on opposite sides of said axis, said beam deflection segments of said coils being interlaced together along the lengths thereof to form on each of said sides a linear array having said beam deflection segments of substantially greater area from one of said coils and said beam deflection segments of substantially lesser area from the other of said coils.

13. The tube of claim 12, wherein:

said beam deflection segments comprising said linear arrays progressively diverge apart along the length of said structure in the direction of propagation of said electron beam.

14. The tube of claim 12, wherein:

each of said coils includes a plurality of rectangular turns, a pair of opposite sides of which are constructed and arranged to form said beam deflection segments of said coil.

15. The tube of claim 12, wherein said deflection structure comprises:

a first half section including a first linear array of interlaced beam deflection segments of substantially greater area and of substantially lesser area and two sets of lead segments extending from opposite sides of said beam deflection segments, a second half section similar to said first half section and including a second linear array of interlaced beam deflection segments of substantially greater area and of substantially lesser area and two sets of lead segments extending from opposite sides of said beam deflection segments; and connections between said lead segments extending from said beam deflection segments of substantially greater area in each of said half sections and said lead segments extending from said beam deflection segments of substantially lesser area in the other of said half sections.

* * * * *